United States Patent [19]

Bratz

[11] Patent Number: 4,874,339

[45] Date of Patent: Oct. 17, 1989

[54] PUMPING TUBULATION GETTER

[75] Inventor: V. David Bratz, Colorado Springs, Colo.

[73] Assignee: SAES Getters S.p.A., Milan, Italy

[21] Appl. No.: 764,134

[22] Filed: Aug. 9, 1985

[51] Int. Cl.[4] ..... H01J 9/00

[52] U.S. Cl. ..... 445/28; 445/55; 252/181.6; 252/181.1

[58] Field of Search ..... 445/28, 55, 43, 31, 445/29; 204/180.1, 180.7; 417/51; 252/181.1, 181.6

[56] References Cited

U.S. PATENT DOCUMENTS

| | | | |
|---|---|---|---|
| 2,254,727 | 9/1941 | Beggs | 313/549 |
| 3,153,190 | 10/1964 | Spalding | 313/549 |
| 3,408,130 | 10/1968 | Fransen | 445/55 |
| 3,820,919 | 6/1974 | Katz | 252/181.6 |
| 3,926,832 | 12/1975 | Barosi | 252/181.6 |
| 4,007,431 | 2/1976 | Abbink | 445/28 |
| 4,107,016 | 8/1978 | Brower, Jr. | 204/180.7 |
| 4,203,049 | 5/1980 | Kuus | 252/181.1 |

*Primary Examiner*—Kurt Rowan

*Attorney, Agent, or Firm*—David R. Murphy

[57] ABSTRACT

The present invention describes a pumping tubulation getter device comprising a hollow cylindrical tube of compression bondable metal and an electrophoretically deposited layer of porous sintered non-evaporable getter material selectively deposited on the internal surface of the hollow cylindrical tube having getter material free zones at the ends of the tube. The pumping tubulation getter device is used in the manufacture of many types of electron discharge devices including ring laser gyroscopes.

4 Claims, 1 Drawing Sheet

PUMPING TUBULATION GETTER

BACKGROUND TO THE INVENTION

Getter devices are well known in the art and are used for a variety of reasons.

One use is to maintain the vacuum in electrical discharge vessels thus increasing the effective working life. Getter devices can also be used within gas or vapour filled electrical discharge vessels where their main function is to reduce reactive gases.

Getter materials are usually divided into two main groups.

Getter materials of the first group are called "flash" or "evaporable" getter materials. These getter materials derive their name from the fact that getter material is evaporated from a container by quick heating or flashing. The getter material is then dispersed onto a suitable surface. It is frequently found that, within the electronic device, there is no suitable surface on which to deposit the evaporable getter material. For this and other reasons it is therefore necessary to use "non-evaporable" getter devices. Many non-evaporable getter devices and materials are known. For examples see U.S. Pat. No. 4,312,669; 4,269,624; 4,146,497; 4,137,012; 4,119,488; 3,961,897; 3,926,832; 3,620,645; 3,203,901; and 3,584,253.

In some cases, the physical dimensions of a getter device itself constitute a problem for the location of the getter device within the electron tube. To some extent this has been solved by placing the getter device within the pumping tubulation provided to evacuate the device. Examples of such a location are provided in U.S. Pat. No. 3,784,862 in the case of an evaporable getter and in Italian Patent No. 1,011,230 for the case of a non-evaporable getter.

Whether the getter be evaporable or non-evaporable it is necessary to provide the getter device with a support element to position it within the tubulation. With the getter device of Italian Patent No. 1,011,230, in order to provide activation of the getter device by high frequency induction heating it is necessary to provide a section of the tubulation in ceramic material which adds considerably to the expense of the tube. It is also known that when space is at a premium, a getter device with an internal spiral heater such as the one described in U.S. Pat. No. 3,584,253 can be used. However, this requires the use of special chambers provided with electrical feedthroughs which again is very expensive. Furthermore, when the getter is provided with a support element or is provided with a self-contained heater, when it is subjected to shock or vibration, the getter device may detach from its required position or provoke the production of loose particles.

It is therefore an object of the present invention to provide a getter device for a pumping tubulation which is free from one or more defects of prior getter devices.

It is one object of the present invention to provide a getter device free from a separate support element.

It is another object of the present invention to provide a getter device in a pumping tubulation which can be heated by HF induction currents without the necessity of providing a ceramic portion to the tubulation.

It is a further object of the present invention to provide a getter device which does not require the use of special chambers.

It is yet another object of the present invention to provide a getter device for a pumping tubulation which is free from the production of loose particles in the presence of shocks or vibrations.

BRIEF DESCRIPTION OF THE INVENTION

These and other objects of the present invention can be obtained by use of high selectively deposited electrophoretic porous sintered non-evaporable getter material within the pumping tubulation directly on the tubulation.

DETAILED DESCRIPTION OF THE INVENTION

The present invention provides an improved pumping tubulation getter device comprising a hollow cylindrical tube of compression bondable metal, said hollow cylindrical tube having an internal surface, and an electrophoretically deposited layer of porous sintered non-evaporable getter material selectively deposited on the internal surface of the hollow cylindrical tube having getter material free zones at the ends of the tube and a method of manufacturing an electron discharge device using the improved getter device.

Figure 1:
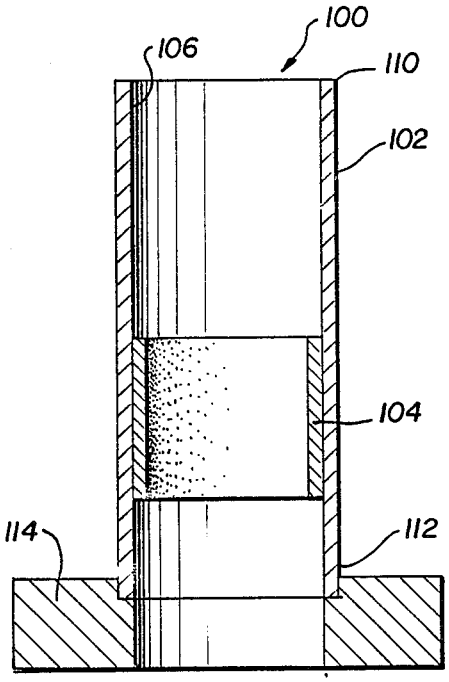
FIG. 1 is a cross-section of a pumping tubulation getter device of the present invention.

Reference is now made to FIG. 1 which shows a pumping tubulation getter device 100. Pumping tubulation getter device 100 comprises a hollow cylindrical tube 102 of compression bondable metal. Examples of compression bondable metals are nickel, copper, stainless steel, nichrome or any metal that can be mechanically pinched off. Compression bonding pinch-off tools are available on the market such as those available from Varian Associates and described in data sheet VAC 2098. One preferred metal is oxygen free high conductivity copper tubing (OFHC) which readily forms a vacuum tight seal on pinch-off. The outside diameter of the tubulation is limited only by the diameter which can be successfully pinched-off. However, the outside diameter should preferably be no greater than about 12.7 mm (0.5 inch). The wall thickness of the tubulation is determined by the metal chosen as some metals are more difficult to pinch-off than others. The internal diameter of the tube is determined by the minimum diameter within which a getter material may be electrophoretically deposited. The external diameter may also be determined by the particular application in which the tubulation is used. Hollow cylindrical tube 102 supports an electrophoretically deposited layer 104 of porous sintered non-evaporable getter material. The electrophoretic deposition of such getter materials is described in Italian Patent Application No. 20096 A/84 filed on 16 Mar. 1984 and Italian Patent Application No. 20097 A/84 also filed on 16 Mar. 1984. The getter material is selectively deposited on the internal surface of the hollow cylindrical tube 102 so as to leave a first getter material free zone 106 and a second getter material free zone 108 at a first end 110 and second end 112 of hollow cylindrical tube 102.

As shown in FIG. 1 hollow cylindrical tube 102 is provided at its second end 112 with the mounting block 114 for mounting of the pumping tubulation getter device 100 onto the electron device with which it is to be associated. If a mounting block is used it could also be in the form of a high vacuum flange.

In the broadest sense of the invention any non-evaporable getter material capable of being deposited electrophoretically on the internal surface of a hollow cylindrical tube of compression bondable metal may be used. However, the getter material preferably comprises a powdered getter metal selected from the group consisting of Zr, Ta, Hf, Nb, T, Th and U in intimate mixture with an antisintering material. The pumping tubulation getter device is then heated in vacuum to such a temperature for such a time as to provide a porous sintered non-evaporable getter layer as described in the two Italian Patent Applications supra.

If it is desired to use an antisintering material which also has gettering properties it is preferable to use a getter metal alloy. One preferred binary alloy with these properties is a Zr—Al alloy comprising from 5 to 30 percent weight of aluminium balance zirconium. The more preferred Zr—Al alloy has 84% wt of zirconium and 16% wt of aluminium. Other binary alloys suitable for use in the present invention are for example: Zr—Ni alloys or Zr—Fe alloys. Ternary alloys can also be used for example: Zr—Ti—Fe alloys or preferably Zr—$M_1$—$M_2$ alloys in which $M_1$ is a metal selected from the group consisting of vanadium and niobium and $M_2$ is a metal selected from the group consisting of nickel and iron. The most preferred ternary alloy is a Zr—V—Fe alloy.

An even more preferred getter material comprises:

(A) a sintered particulate getter metal selected from the group consisting of Zr and Ti the particles of which pass through a U. S. standard screen of 200 mesh/inch, and (B) a particulate zirconium-aluminium alloy comprising 5 to 30 weight percent aluminium balance zirconium wherein the particles of zirconium-aluminium alloy are larger than the particles of the non-evaporable getter metal and are distributed throughout the non-evaporable getter metal, wherein the sintered non-evaporable getter metal has a surface area after sintering substantially equal to its surface area prior to sintering, wherein the weight ratio A:B is from 19:1 to 2:3 and wherein said particles of zirconium-aluminium alloy are generally spaced out of contact with each other.

It will be appreciated that the sintered non-evaporable getter metal (A) may also be the metal in the form of a hydride and that the antisintering material B may also be graphite or refractory metal such as tungsten, molybdenum, niobium and tantalum.

Figure 2:
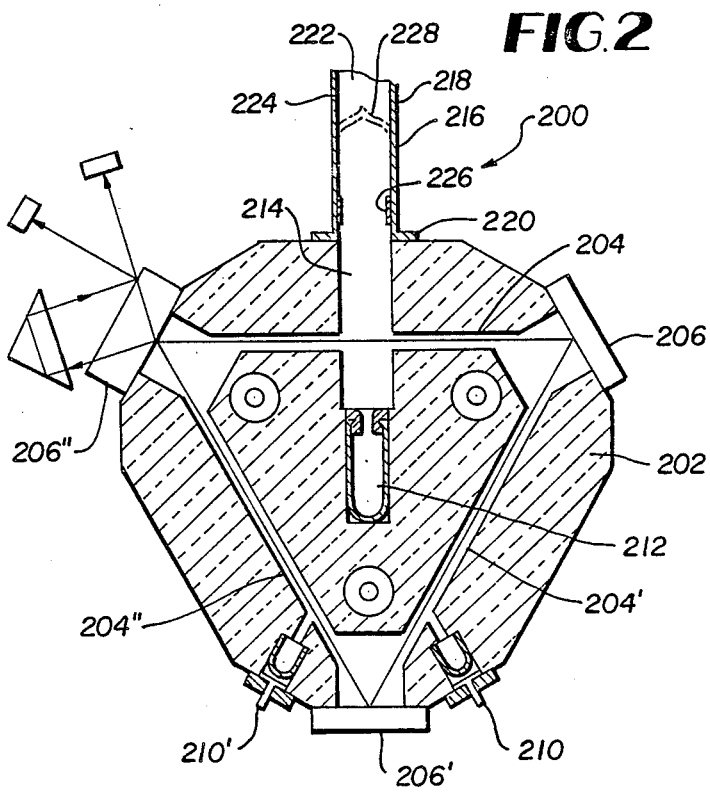
FIG. 2 is a cross-sectional representation of a ring laser gyroscope using a pumping tubulation getter device of the present invention.

For a better understanding of the use of a pumping tubulation getter device in the manufacture of an electron discharge device according to the present invention reference is made to FIG. 2 which shows a ring laser gyroscope 200. It will be realized that a ring laser gyroscope has been chosen for illustrative purposes only as an example of an electron discharge device which is particularly suitable for use in combination with a pumping tubulation getter device of the present invention. Its detailed description hereinafter is not intended to limit the scope of the appended claims to such a device. Ring laser gyroscope 200 comprises a body 202 having a low temperature coefficient of expansion such as quartz or ceramic. Channels 204, 204' and 204'' are provided for a production of the laser beams. The channels are sealed by means of reflecting mirrors 206, 206' and 206''. Mirror 206'' also serves as an output port for the ring laser gyroscope output signal. Two anodes 210 and 210' in combination with cathode 212 are used in the production of two laser beams, one travelling clockwise and the other travelling counterclockwise within the gyroscope. Body 202 is also furnished with an exhaust channel 214. To the outer wall 216 of body 202 is attached, in correspondence with exhaust channel 214, a pumping tubulation getter device 218 by means of a mounting block 220. The free end 222 of the pumping tubulation getter device 218 is attached to a vacuum pumping system (not shown). Within the hollow cylindrical tube 224 of pumping tubulation getter device 218 there is selectively deposited a layer 226 of porous sintered non-evaporable getter material. Vacuum pumping is initiated and the ring laser gyroscope 200 is heated to a sufficient temperature for a sufficient time to reduce the pressure within the gyroscope to a value below about $10^{-6}$ torr ($10^{-4}$ Pa). At the termination of this bakeout procedure the mounting block 220 area is cooled by forced air while a radio frequency coil around the area in which the getter material is situated heats the tubulation and getter material thus activating it. When this area of the tubulation is cooled the tubulation is pinched off to form a vacuum tight seal 228 after having backfilled the ring laser gyroscope 200 with a lasing medium such as a mixture of helium and neon. The method of the present invention can be used to manufacture electron discharge devices such as a ring laser gyroscope, a travelling wave tube, an evacuated switch, a circuit breaker, a lightning arrester, or a hermetically sealed semi-conductor. Although the invention has been described in considerable detail with reference to certain embodiments thereof it will be understood that variations and modifications can be made within the spirit and scope of the invention as described above and as defined in the appended claims.

What is claimed is:

1. A method of manufacturing a ring laser gyroscope comprising the steps of:

(f) attaching one end of a pumping tubulation getter device to the outer wall of the ring laser gyroscope wherein the pumping tubulation getter device comprises:

(I) a hollow cylindrical tube of oxygen free high conductivity copper tubing adapted to be compression bonded by means of a pinch-off tool for the formation of the vacuum tight seal; and (II) an electrophoretically deposited layer of porous sintered non-evaporable getter material selectively deposited on the internal surface of the hollow cylindrical tube leaving getter free zones at the ends of the hollow cylindrical tube; wherein the getter material comprises:

A. a sintered particulate getter material selected from the group consisting of Zr and Ti the particles of which pass through a U.S. standard screen of 200 mesh/inch; and B. a particulate zirconium-aluminium alloy comprising 5 to 30 weight percent aluminium balance zirconium wherein the particles of zirconium-aluminium alloy are larger than the particles of the non-evaporable getter metal, wherein the sintered non-evaporable getter metal has a surface area after sintering substantially equal to its surface area prior to sintering, wherein the weight ratio A:B is from 19:1 to 2:3 and wherein said particles of zirconium-aluminium alloy are generally spaced out of contact with each other;

(ii) evacuating the ring laser gyroscope via the hollow cylindrical tube; and (iii) heating the ring laser gyroscope to a temperature of from 25° C. to 280° C. for a time of from 30 minutes to 5 days; and (v) compression bonding the second end of the getter device by means of a pinch-off tool to form a vacuum tight seal.

2. A ring laser gyroscope manufactured according to claim 1.

3. A method of manufacturing a ring laser gyroscope comprising the steps of:

(i) attaching one end of a pumping tubulation getter device to the outer wall of the ring laser gyroscope wherein the pumping tubulation getter device comprises:

(I) a hollow cylindrical tube of oxygen free high conductivity copper tubing adapted to be compression bonded by means of a pinch-off tool for the formation of the vacuum tight seal; and (II) an electrophoretically deposited layer of porous sintered non-evaporable getter material selectively deposited on the internal surface of the hollow cylindrical tube leaving getter free zones at the ends of the hollow cylindrical tube; wherein the getter material comprises:

A. a sintered particulate getter material selected from the group consisting of Zr and Ti the particles of which pass through a U.S. standard screen of 300 mesh/inch; and B. an antisintering material selected from the group consisting of:

(a) a Zr—Al alloy comprising from 5 to 30 percent weight of aluminum balance zirconium; and (b) a Zr—Ni alloy; and (c) a Zr—Fe alloy; and (d) a Zr—$M_1$—$M_2$ alloy in which $M_1$ is a metal selected from the group consisting of vanadium and niobium and $M_2$ is a metal selected from the group consisting of nickel and iron; and (e) graphite; and (f) tungsten; and (g) molybdenum, and (h) niobium; and (i) tantalum; and wherein the weight ratio A:B is from 19:1 to 2:3 and wherein said particles of zirconium-aluminum alloy are generally spaced out of contact with each other; and (ii) evacuating the ring laser gyroscope via the hollow cylindrical tube; and (iii) heating the ring laser gyroscope to a temperature of from 25° C. to 280° C. for a time of from 30 minutes to 5 days; and (iv) activating the getter material by high frequency induction heating while air cooling the tube wall attachment area; and (v) compression bonding the second end of the getter device by means of a pinch-off tool to form a vacuum tight seal.

4. A method of manufacturing a ring laser gyroscope comprising the steps of:

(i) attaching the first end of a pumping tubulation getter device to the outer wall of the ring laser gyroscope in fluid communication therewith: wherein the pumping tubulation getter device comprises:

(I) a hollow cylindrical metal tube; and (II) an electrophoretically deposited layer of porous sintered non-evaporable getter material on the internal surface of the hollow cylindrical metal tube leaving zones which are free of getter material at the first and second ends of the hollow cylindrical metal tube;

wherein the getter material comprises:

A. a sintered particulate getter metal selected from the group consisting of Zr and Ti; and B. a particulate antisintering material having a melting point higher than the melting point of the getter metal; and then (ii) evacuating the ring laser gyroscope via the hollow cylindrical tube; and then (iii) heating the ring laser gyroscope to a temperature of from 25° C. to 280° C. for a time sufficient to substantially completely evacuate the ring laser gyroscope; and then (iv) activating the getter material by high frequency induction heating; and then (v) forming a vacuum tight seal in the second end of the getter device.

* * * * *

UNITED STATES PATENT AND TRADEMARK OFFICE

CERTIFICATE OF CORRECTION

PATENT NO. : 4,874,339

DATED : October 17, 1989

INVENTOR(S) : V. David Bratz

It is certified that error appears in the above-identified patent and that said Letters Patent is hereby corrected as shown below:

In Claim 1, at Column 5; after Line 7 and before Line 8, insert missing paragraph "(iv)" which reads as follows:

--(iv) activating the getter material by high frequency induction heating while air cooling the tube wall attachment area; and--

In Claim 3, at Column 5; at about Line 32, the figure of "300" should be --200--.

Signed and Sealed this

Thirtieth Day of October, 1990

*Attest:*

HARRY F. MANBECK, JR.

*Attesting Officer*

*Commissioner of Patents and Trademarks*